US006878030B1

(12) United States Patent
Nelson

(10) Patent No.: US 6,878,030 B1
(45) Date of Patent: Apr. 12, 2005

(54) PLASMA REACTOR FOR TREATING AUTO EMISSIONS—DURABLE AND LOW COST—CURVED SHAPES

(75) Inventor: David Emil Nelson, Waterford, MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/517,879

(22) Filed: Mar. 2, 2000

Related U.S. Application Data

(60) Provisional application No. 60/141,401, filed on Jun. 29, 1999.

(51) Int. Cl.[7] ..... H01J 9/04
(52) U.S. Cl. ..... 445/58; 445/22
(58) Field of Search ..... 445/58, 22; 422/174, 422/177, 180, 186.04; 60/275

(56) References Cited

U.S. PATENT DOCUMENTS

| | | | | |
|---|---|---|---|---|
| 5,062,911 | A | * 11/1991 | Hampton et al. | 156/89.14 |
| 6,338,827 | B1 | 1/2002 | Nelson et al. | |
| 6,354,903 | B1 | * 3/2002 | Nelson | 445/58 |
| 6,368,451 | B1 | 4/2002 | Goulette et al. | |
| 6,423,190 | B2 | 7/2002 | Hemingway et al. | |
| 6,464,945 | B1 | 10/2002 | Hemingway | |
| 6,482,368 | B2 | 11/2002 | Hemingway et al. | |
| 6,537,507 | B2 | 3/2003 | Nelson et al. | |
| 6,638,484 | B2 | * 10/2003 | Nelson et al. | 422/186.04 |

* cited by examiner

*Primary Examiner*—Joseph Williams
(74) *Attorney, Agent, or Firm*—Paul L. Marshall

(57) ABSTRACT

A non-thermal plasma reactor for conversion of exhaust gas constituents is characterized by a reactor element prepared from a curved, swept-shaped substrate specifically designed for fabrication via extrusion. The as-extruded curved substrate comprises a thick outer wall surrounding a plurality of channels separated by dielectric barriers. Selected channels are coated with a conductive material to form conductor channels. The prepared reactor element preferably comprises multiple concentric exhaust channels, multiple concentric conductor channels having alternating polarity, each connected to its respective polarity via bus paths, in-line structural support ligaments for providing optimal structural support while preventing exhaust leakage, and thick outer walls providing high crush resistance and allowing robust mounting into the reactor housing.

The nested, concentric arrangement and curved shape substrate advantageously enhances the reactor's ability to adapt to fit various vehicle sizes. High durability is afforded by the thick outer walls, and preferably, the inclusion of integral structural support ligaments. Fabrication of the extruded curved substrate is from material such as, but not limited to, dense cordierite, alumina, titania, mullite, plastic, and other high dielectric constant materials, or combinations thereof. Improved wall thickness is achieved over prior ceramic plate designs, thus providing the advantage of a more uniform electrical response. Improved resistance to voltage leakage is achieved by containing the channel conductors within dielectric channels (except at ends) and providing a dielectric coating at each end to prevent voltage leaks there.

15 Claims, 3 Drawing Sheets

PLASMA REACTOR FOR TREATING AUTO EMISSIONS— DURABLE AND LOW COST— CURVED SHAPES

CROSS-REFERENCE TO RELATED APPLICATIONS

The present application claims priority to U.S. Provisional Application Ser. No. 60/141,401 filed Jun. 29, 1999, by David E. Nelson, entitled "Method of Manufacturing a Plasma Reactor For Treating Auto Emissions—Durable and Low Cost."

TECHNICAL FIELD

This invention relates to reactors for chemical reduction of nitrogen oxide (NOx) emissions in the exhaust gases of automotive engines, particularly diesel and other engines operating with lean air fuel mixtures that produce relatively high emission of NOx. More particularly, the invention pertains to an improved non-thermal plasma reactor that is durable and low cost.

BACKGROUND OF THE INVENTION

In recent years, non-thermal plasma generated in a packed bed reactor has been shown to be effective in reducing nitric oxides (NOx) produced by power plants and standby generators. These units usually have a reducing agent, such as urea, to enhance the conversion efficiency. The packed bed reactor consists essentially of a high voltage center electrode inserted into a cylinder of dielectric material, usually a form of glass or quartz.

An outside or ground electrode is formed by a coating of metal in various forms, including tape, flame spray, mesh, etc. The space between the center electrode and the inside diameter of the dielectric tube is filled or packed with small diameter glass beads. When high voltage alternating current is applied to the center electrode, the surfaces of the beads go into corona, producing a highly reactive and selective surface for inducing the desired reaction in the gas.

Unfortunately, the packed bed design with its loose beads and glass dielectric is impractical for use in the conditions found in a mobile emitter, such as a car or truck. The vibration and wide temperature swings of the vehicle system would damage the packed bed and the necessary temperature and vibration isolation needed to make it survive would not be cost effective.

A reactor for use with diesel engines and other engines operating with lean air fuel mixtures is disclosed in commonly assigned U.S. patent application Ser. No. 09/465,073 entitled "Non-thermal Plasma Exhaust NOx Reactor," which is hereby incorporated by reference herein in its entirety. Disclosed therein is a reactor element comprising high dielectric, nonporous, high temperature insulating means defining a group of relatively thin stacked cells forming gas passages and separated by the insulating means. Alternate ground and charge carrying electrodes in the insulating means on opposite sides of the cells are disposed close to, but electrically insulated from, the cells by the insulating means. The electrodes may be silver or platinum material coated onto alumina plates. Conductive ink is sandwiched between two thin nonporous alumina plates or other suitable insulating plates to prevent arcing while providing a stable electrode spacing for a uniform electric field. The electrodes are coated onto alumina in a pattern that establishes a separation between the electrodes and the connectors of alternate electrodes suitable to prevent voltage leakage.

In commonly assigned U.S. Provisional Application Ser. No. 60/141,427 filed Jun. 29, 1999 entitled "Design and Method of Manufacturing a Plasma Reactor for Treating Auto Emissions—Stacked Shapes," which is hereby incorporated by reference herein in its entirety, a non-thermal plasma reactor element is prepared from a planar arrangement of formed shapes of dielectric material, which shapes are used as building blocks for forming the region of the reactor wherein plasma is generated. The formed shape defines an internal cell in the plasma reactor having an exhaust passage for flowing exhaust gas to be treated therethrough. Individual cells are provided with a conductive print disposed thereon to form electrodes and connectors. In a preferred embodiment, the conductive print comprises a continuous grid pattern having a cutout region disposed opposite the terminal connector for reducing potential voltage leaks. Multiple extruded cells are stacked and connected together to form a multi-cell stack.

Commonly assigned U.S. Provisional Application Ser. No. 60/141,394 filed Jun. 29, 1999 entitled "Plasma Reactor Design for Treating Auto Emissions—Durable and Low Cost" which is hereby incorporated by reference herein in its entirety, discloses a non-thermal plasma reactor element for conversion of exhaust gas constituents. The reactor comprises an element prepared from an extruded monolith of dense dielectric material having a plurality of channels separated by substantially planar dielectric barriers. Conductive material printed onto selected channels forms conductive channels that are connected along bus paths to form an alternating sequence of polarity, separated by exhaust channels. Conductive channels and channels not selected for exhaust flow are plugged at end portions of the monolith with a material suitable for excluding exhaust gases and for preventing electrical leakage between conductive channels. Exhaust channels, disposed between opposite polarity conductive channels, are left uncoated and unplugged. During operation, exhaust gas flows through exhaust channels and is treated by the high voltage alternating current flowing through the conductive channels. The planar shape of the dielectric barriers provides a uniform electrical response throughout the exhaust channels.

While the above non-thermal plasma reactors meet some of the current needs and objectives, there remains a need in the art for an improved, durable, low cost non-thermal plasma reactor and improved method of manufacturing same. There further remains a need for a non-thermal plasma reactor design that provides flexibility to accommodate varying vehicle packaging requirements. There further remains a need for such a non-thermal plasma reactor that can be prepared with reduced manufacturing complexity, reduced number of components over currently available designs and reduced overall material cost.

SUMMARY OF THE INVENTION

A non-thermal plasma reactor for conversion of exhaust gas constituents comprises a reactor element prepared from a curved, swept-shaped substrate specifically designed for fabrication via extrusion. The as-extruded curved substrate comprises a thick outer wall surrounding a plurality of channels separated by dielectric barriers. Selected channels are coated with a conductive material to form conductor channels. The prepared reactor element preferably comprises multiple concentric exhaust channels, multiple concentric conductor channels having alternating polarity, each connected to its respective polarity via bus paths, in-line structural support ligaments for providing optimal structural support while preventing exhaust leakage, and thick outer walls providing high crush resistance and allowing robust mounting into the reactor housing.

The nested, concentric arrangement and curved shape substrate advantageously enhances the reactor's ability to fit into vehicles. High durability is afforded by the thick outer walls, and preferably, the inclusion of integral structural support ligaments. Fabrication of the extruded curved substrate is from material such as, but not limited to, dense cordierite, alumina, titania, mullite, plastic, and other high dielectric constant materials, or combinations thereof. Improved wall thickness is achieved over prior ceramic plate designs, thus providing the advantage of a more uniform electrical response. Improved resistance to voltage leakage is achieved by containing the channel conductors within dielectric channels (except at ends) and providing a dielectric coating at each end to prevent voltage leaks there.

These and other features and advantages of the invention will be more fully understood from the following description of certain specific embodiments of the invention taken together with the accompanying drawings.

BRIEF DESCRIPTION OF THE DRAWINGS

Referring now to the drawings, which are meant to be exemplary, not limiting, and wherein like elements are numbered alike in the several figures:

FIG. 3 is a view of the embodiment shown in FIG. 1 with the mask on.

DESCRIPTION OF THE PREFERRED EMBODIMENT

Figure 1:
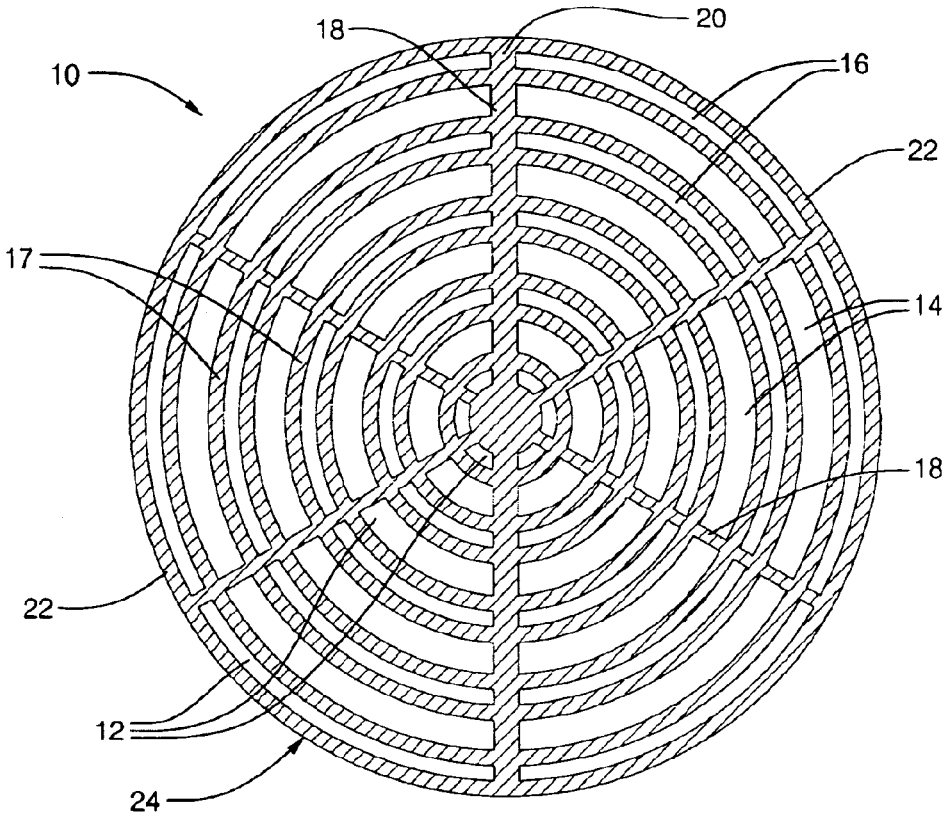
FIG. 1 is a cross-sectional view of the face of an uncoated as-extruded curved substrate in accordance with an embodiment of the present invention.

FIG. 1 shows a cross-section of an extruded round substrate 10 formed in accordance with one possible embodiment of the present invention. The extruded reactor substrate 10 comprises concentric curved channels 12 for preparing exhaust channels 14 from the relatively thick channels 14 and conductor channels 16 from the relatively thin channels 16. The curved, swept shape provides considerable flexibility to accommodate various vehicle packaging requirements.

Any suitable dielectric substrate material may be employed to form the curved substrate 10 including, but not limited to, alumina, dense cordierite, mullite, titania, plastic, and other high dielectric constant materials, or a combination thereof.

The concentric curved channels 12 are processed (substrate after processing shown in FIG. 4) to form alternating relatively thick exhaust channel passages 14 and relatively thin conductor channels 16 (i.e., the dimensions of the exhaust channel passages 14 are thick relative to the dimensions of the conductor channels 16). A tightly controlled dielectric barrier thickness layer 17 separates the alternating thick exhaust channel passages 14 and thin conductor channels 16.

In a preferred embodiment, structural support ligaments 18 are provided to enhance substrate 10 integrity. Ligaments 18 are integrally formed as part of the extruded substrate. One or more structural support ligaments 18 may further serve as a substrate for conductive bus paths 20. Preferably, a minimal number of structural support ligaments 18 are employed so as to minimize flow loss. Structural ligaments 18 are coated with conductive medium during formation of the conductor channels 16 and the structural ligaments 18 thus coated serve to ensure robust electrical connections to each conductive channel 16 wall.

Thick outer wall 22 surrounds the curved substrate 10 providing mechanical strength to the prepared reactor element and an insulating barrier against voltage leakage. In a preferred embodiment, thick outer wall 22 has a thickness of about 1 millimeter to about 5 millimeters. In another preferred embodiment, thick outer wall 22 has a rough outer surface that increases the ability of the housing mounting system to grip the wall 22 and enables the substrate 10 to resist telescoping relative to the reactor housing during use.

Preferably, the face of the coated substrate 10 is provided with an insulating sealant 24 to protect the bus paths 20 and inhibit voltage leaks. The insulating sealant 24 may be any suitable sealant material known in the art, including, but not limited to, glass frit, ceramic-based coatings, encapsulents, or combinations thereof. For example, a glass frit and binder may be used to plug the conductive channels 16 after coating. Alternately, a seal may be glued to the substrate 10, such as an alumina cover plate with cutouts.

Dimensions for the various channels 12 and layers comprising the substrate 10 are selected in accordance with performance and design criteria and selection of dielectric material. For example, dimensions for the dielectric barrier thickness layer 17 are selected in accordance with the particular dielectric material used, the dimensions of the relatively thick exhaust channel passages 14 and the relatively thin conductor channels 16, the spacing of the structural ligaments 18, if any, the total number of cells, the width of the electrical bus paths 20, and the thickness of the outer wall 22.

Figure 2:
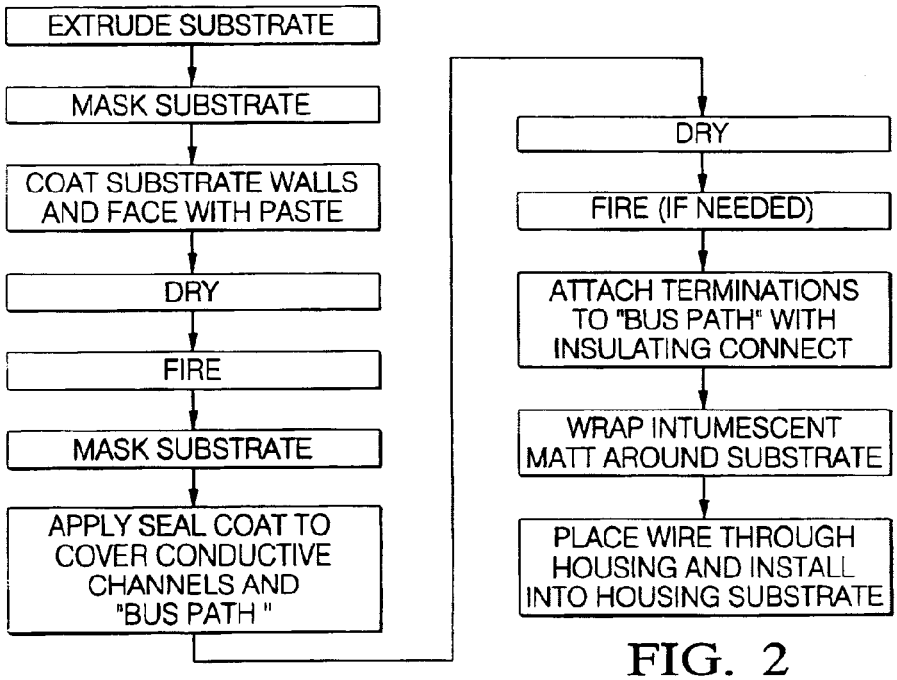
FIG. 2 is a process flow diagram of the method of manufacturing a plasma reactor in accordance with the present invention.

FIG. 2 provides a process flow diagram for preparing the present non-thermal plasma reactor. A method for preparing the present non-thermal plasma reactor design is provided in commonly assigned, Provisional application Ser. No. 60/141,403, filed Jun. 29, 1999, by David E. Nelson, entitled "Design and Method of Manufacture of a Plasma Reactor With Curved Elements for Treating Auto Emissions," which is hereby incorporated by reference herein in its entirety. Generally, the steps comprise extruding a curved substrate 10, masking the substrate 10 with a mask 26, coating with conductive paste, drying, and firing to form the thin conductor channels 16 and bus paths 20. Masking is repeated for the purposes of applying a sealing coat (not shown) to cover the thin conductor channels 16 and bus paths 20, drying, and firing (if needed). Electrical connections (not shown) are made by attaching terminations to the bus paths 20 with insulating connects, wrapping an insulator, such as an intumescent matt, around the substrate 10, inserting shielded wire through the reactor housing, and installing the substrate 10 the housing (housing not shown).

Figure 3:
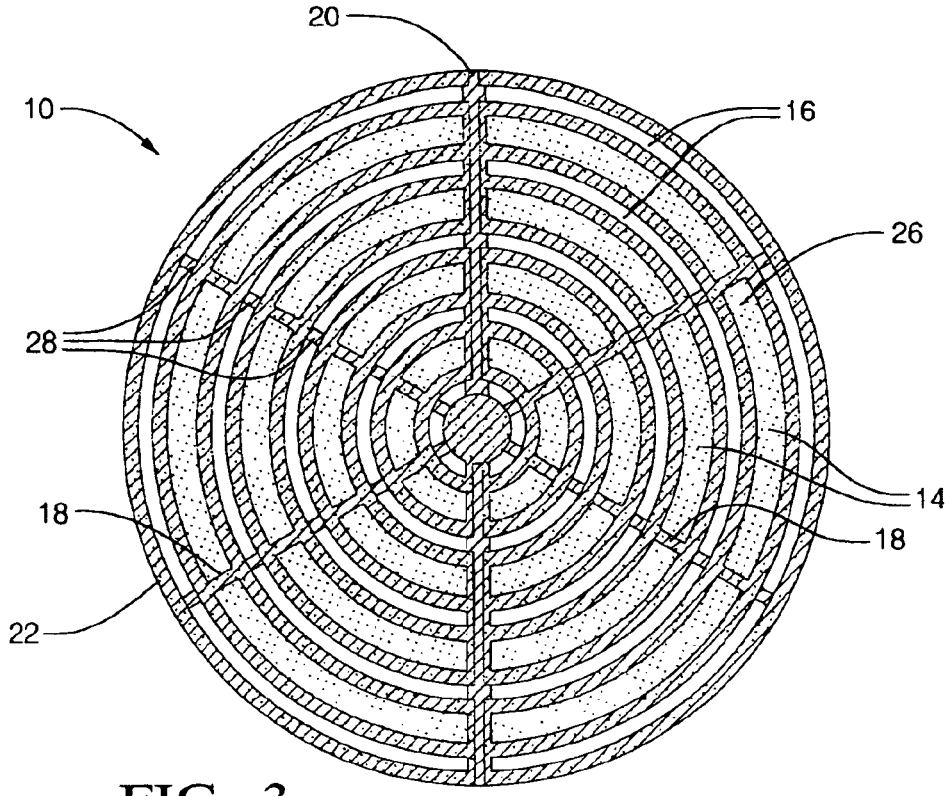

FIG. 3 provides a view of the substrate 10 after the mask 26, typically comprising an emulsion on a screen, is registered against the face of the substrate 10. While a mask 26 is used to focus the conductive media where desired, a thixotropic conductive medium may be used to enhance placement of the medium. Ultrasonic vibration and gravity may be employed to coat one wall of the conductor channel 16 and the substrate 10 may then be flipped to coat the opposite wall. Typically, conductive material is dispersed within selected channels and a vacuum is applied to remove excess conductive material. This approach effectively coats all interior walls of conductor channels 16.

Conductive media used to form the conductor channels 16 may comprise any conductive media providing the desired durability, temperature capability, and desired cost parameters. Typically, the conductive media will perform at temperatures up to about 600° C. Suitable conductive media include, but are not limited to, silver inks, aluminum inks, and copper inks.

Exhaust channels 14 are not typically coated, with conversion of exhaust gas constituents occurring substantially only by electrical means. In another embodiment, a catalytic coating may be disposed against interior walls of exhaust channels 14 to promote the conversion reactions at reduced power consumption.

In an alternate embodiment designed to enhance robust electrical connections across structural support ligaments 18, the structural support ligaments 18 are removed from conductor channels 16 prior to coating (indicated by numeral 28 in FIG. 3). For example, an approximately 10 millimeter section of the structural support ligaments 18 may be removed in order to establish continuous conductive paths along the conductor channels 16. In another embodiment, electrical connections are provided by disposing conductive coating on the face ends of the structural ligaments 18 in the conductor channels 16. In yet another embodiment, the structural ligaments 18 are lined up between the conductor channels 16 and the exhaust channels 14 to ensure that there are no uncoated areas in the conductor channels 16.

Conductive medium that may deposit on the back face (not shown) of the substrate 10 is removed. For example, the substrate 10 may be cut with a dicing saw after firing to remove a portion of the substrate end.

Figure 4:
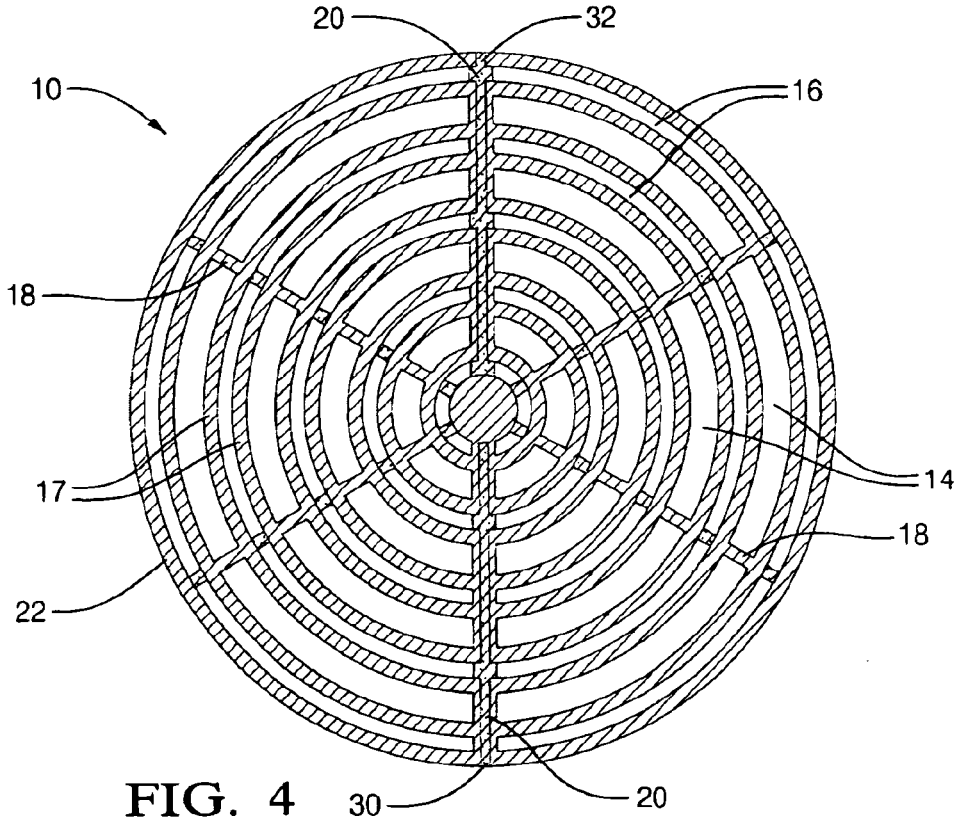
FIG. 4 is a view of the embodiment shown in FIG. 1 with the conductive media applied thereto.

FIG. 4 shows a view of the substrate 10 after the mask 26 has been removed and the substrate 10 has been dried and fired. The conductive layer coats the walls of the thin channels (now conductive channels 16) and connects to positive and negative bus paths 20 that lead to positive and negative terminals 30, 32, ultimately connecting to a power supply (not shown).

Figure 5:
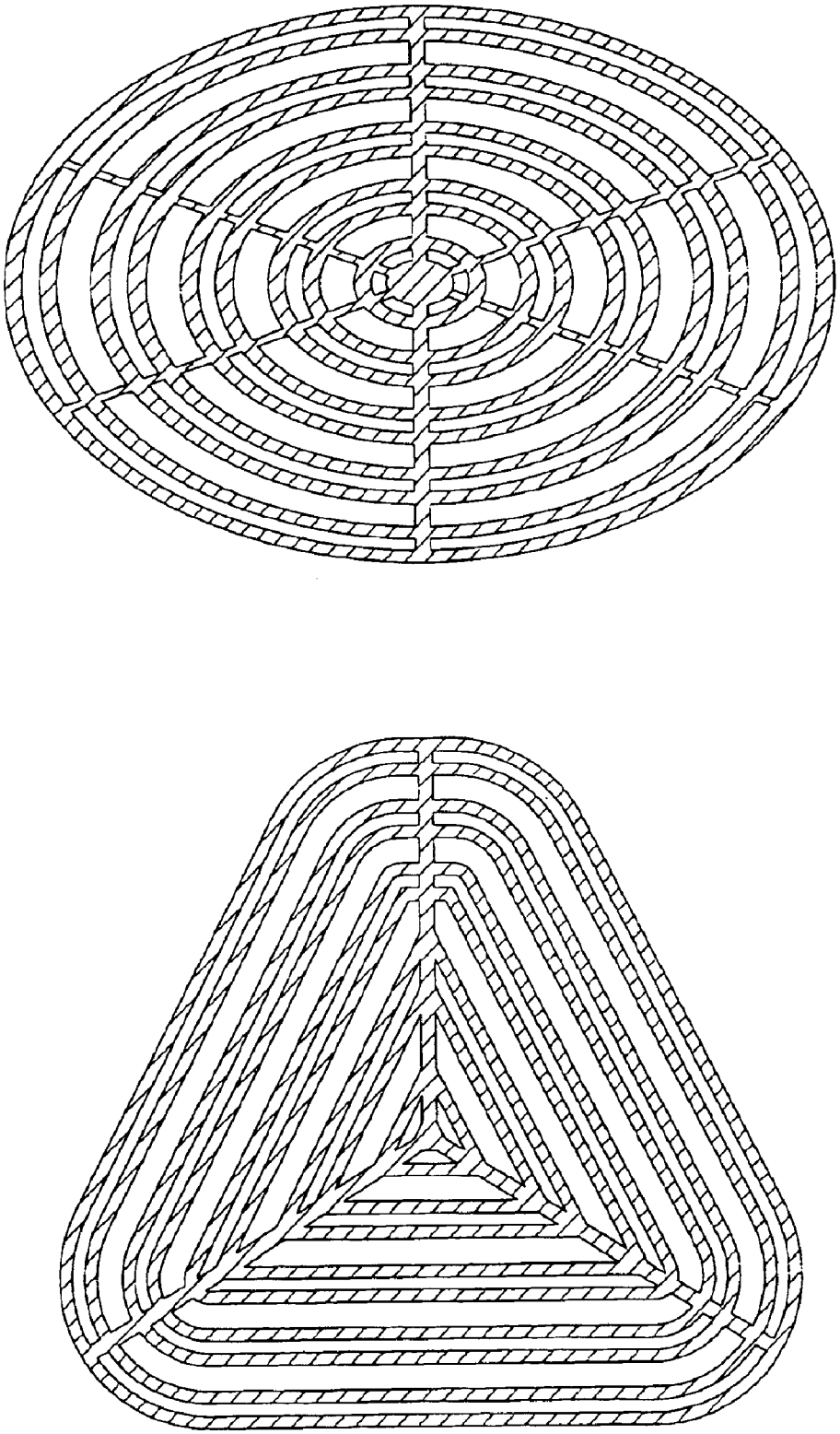
FIG. 5 is a view of two alternate embodiments for the curved substrate shape in accordance with the present invention.

The embodiment of FIG. 1 shows a substrate 10 having a round shape. The present invention encompasses curved and swept shapes generally, and numerous shape variations are considered within the scope of the present invention. FIG. 5 provides a view of two alternate embodiments for substrate 10 shapes suitable for the present non-thermal plasma reactor. Alternate shaped embodiments include, but are not limited to, round, oval, racetrack, and trapezoid shapes.

The space velocity of gas passing through a plasma reactor can be very high, with levels that may exceed 1 million inverse hours. The present invention achieves a low backpressure while taking advantage of the capability for a very high gas space velocity by providing a shape comprising a large frontal area and a short length (relative to the frontal area). In a preferred embodiment, the substrate 10 comprises a frontal area that is sufficiently large to achieve a low backpressure while the reactor length is adjusted to achieve the desired gas space velocity in accordance with the particular engine emission system.

The present reactor provides the advantage of reduced components compared to previous designs such as stacked plate designs. The present reactor provides robust coating of the substrate surface to provide excellent repeatability of electrical performance thus achieving a stable plasma. Wire connections can be made directly to the bus path and do not require expensive connections to multiple cells. The curved, swept shapes provide design flexibility and allow the reactor to be adapted for varying vehicle requirements.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

What is claimed is:

1. A non-thermal plasma reactor characterized by:

an element prepared from an extruded curved substrate comprising an outer wall surrounding a plurality of concentric channels separated by dielectric barriers, said element comprising:

a plurality of exhaust channels for passing a flow of gas therethrough; and a plurality of conductor channels, said conductor channels having alternating polarity, each connected to its respective polarity via bus paths.

2. The reactor of claim 1, wherein said curved substrate comprises a dielectric substrate material selected from the group consisting of alumina, dense cordierite, mullite, titania, plastic, materials having a high dielectric constant, and combinations thereof.

3. The reactor of claim 1, wherein said exhaust channels are thick relative to said conductor channels.

4. The reactor of claim 1, further comprising:

a catalytic coating disposed on interior walls of said exhaust channels.

5. The reactor of claim 1, wherein said conductor channels are coated with conductive media selected from the group consisting of silver inks, aluminum ink, and copper inks, and combinations thereof.

6. The reactor of claim 1, further comprising:

structural support ligaments, wherein said ligaments comprise an integrally extruded portion of said curved substrate.

7. The reactor of claim 6, wherein at least one structural support ligament serves as a substrate for said conductive bus paths.

8. The reactor of claim 6, wherein portions of said structural support ligaments are removed from said conductor channels in order to ensure continuous conductive paths along said conductor channels.

9. The reactor of claim 6, wherein face ends of said structural support ligaments disposed in said conductor channels have a conductive coating disposed thereon.

10. The reactor of claim 6, wherein said structural support ligaments are lined up between said conductor channels and said exhaust channels so that there are essentially no uncoated areas in said conductor channels.

11. The reactor of claim 1, further comprising:

an electrical insulating sealant.

12. The reactor of claim 1, wherein said curved substrate comprises a shape selected from the group consisting of curved, swept, round, oval, racetrack, and trapezoid shapes.

13. The reactor of claim 1, wherein said curved substrate comprises a shape comprising a large frontal area and a length that is short relative to said frontal area.

14. The reactor of claim 1, wherein said curved substrate comprise a shape having a frontal area that is sufficiently large to achieve a low backpressure and a length adjusted to achieve a desired gas space velocity in accordance with a particular engine emission system.

15. The reactor of claim 1, comprising wire connections made directly to said bus paths.

* * * * *